United States Patent [19]

Riedl et al.

[11] Patent Number: 4,619,439

[45] Date of Patent: Oct. 28, 1986

[54] LIFTING AND DEPOSITING DEVICE FOR PORTABLE CONTAINERS, COMPARTMENTS, CONTAINERS, SHELTERS OR THE LIKE

[75] Inventors: Reinhold Riedl, Miltenberg; Conrad Lazarus, Freudenberg, both of Fed. Rep. of Germany

[73] Assignee: Haacon Hebetechnik GmbH, Freudenberg, Fed. Rep. of Germany

[21] Appl. No.: 581,200

[22] Filed: Feb. 17, 1984

[30] Foreign Application Priority Data

Feb. 19, 1983 [DE] Fed. Rep. of Germany ..... 3305847

[51] Int. Cl.[4] ..... B66F 7/26

[52] U.S. Cl. ..... 254/45; 254/103; 254/111

[58] Field of Search ..... 254/45, 89 R, 103, 108–111, 254/95, 97

[56] References Cited

U.S. PATENT DOCUMENTS

| | | | |
|---|---|---|---|
| 776,881 | 12/1904 | Ambrose | 254/103 |
| 1,511,209 | 10/1924 | Armstrong | 254/111 |
| 2,528,011 | 10/1950 | Lucker | 254/111 |
| 2,630,297 | 3/1953 | Hunz | 254/109 |
| 4,045,000 | 8/1977 | Mai | 254/45 |

*Primary Examiner*—Frederick R. Schmidt
*Assistant Examiner*—Judy J. Hartman
*Attorney, Agent, or Firm*—Quaintance, Murphy & Presta

[57] ABSTRACT

For the handling of portable large containers, lifting and depositing devices are used, which have rack and pinion jacks to be attached to the corners of the containers by brackets. There rack and pinion jacks have tubular winch shanks which are approximately the height of the containers, into which are guided tubular uprights with the racks. Because of tolerance variations, the danger here arises of an impaired guidance of the uprights with the result of a poor operation of the gearing. To avoid this difficulty, a guide tube is connected with the bottom end of each tubular winch shank. Guide surfaces in the guide tube can be produced with great precision and at low cost. The housing of the winch gearing is configured integral with the guide tube. Thus, a small amount of side play can be left between the upright and winch shank without adversely affecting the rack and pinion gearing operation.

2 Claims, 6 Drawing Figures

LIFTING AND DEPOSITING DEVICE FOR PORTABLE CONTAINERS, COMPARTMENTS, CONTAINERS, SHELTERS OR THE LIKE

BACKGROUND OF THE INVENTION

The present invention relates to a lifting and depositing device for portable containers, e.g., compartments, containers, shelters or the like, with rack and pinion jacks to be connected to the container corners by means of brackets, of which the racks are provided on preferably tubular uprights, which are guided in tubular winch shanks of approximately the height of the container, to which are fastened the brackets and to each a winch gearing.

Lifting and depositing devices of this type have already been disclosed, e.g., in U.S. Pat. No. 4,045,000 and German DE-GM No. 7 502 135. Each of these devices has four rack and pinion jacks, which in turn have two brackets and one hinged tie bar attached to them on the standardized corner fittings of a container. By means of suitable operation of the rack and pinion jacks, which are generally operatively connected to each other in pairs connected by a shaft, the container can be lifted from a loading surface of a truck and then can be deposited on the ground, or can be lifted from the ground and deposited on the loading surface.

A problem with these rack and pinion jacks is the guidance system for the uprights including their racks in the tubular winch shafts which are approximately of container height. Because of tolerance variations and the resulting defective guidance of the uprights in the winch shanks, a great danger exists that the drive bevel gears of the winch gearing do not engage exactly in the racks, which leads to premature wear and tear and a very poor rack and pinion gearing operation. To avoid these drawbacks and to provide an improved guidance system of the uprights and tolerance compensation, it is also already known to construct slide bearing elements in the tubular winch shank which are tolerance-equalizing. However, this measure is uneconomical particularly with assembly line production, since suitable selection of the slide bearing element for the individual rack winches requires relatively too much time.

SUMMARY OF THE INVENTION

Therefore, an object of the invention, with a lifting and depositing device with rack and pinion jacks, is to improve this type of structure for the guidance of the uprights, including their racks, in the tubular winch shanks, by means of simple structural measures, and so to improve it that satisfactory rack and pinion gearing operations are maintained and economical production is guaranteed in assembly line manufacture.

This object is attained according to the invention in that a guide tube for accurately fitting guidance of each upright is connected with a toothed rack and the bottom end of the tubular winch shank of the rack and pinion jack, and the length of the guide tube is only a fraction of that of the tubular winch shank on which the winch gearing is arranged. The exact guidance of the uprights with their racks is thus concentrated in a relatively short tube element at the bottom ends of the tubular winch shanks and thus advantageously in the gearing area, so that it is assured that the drive bevel gearing can engage the winch gearing correctly on the uprights in the rack. The guide surfaces of the relatively short guide tubes can be formed economically by machining. The exact axial connection required of the guide tube with the winch shanks can likewise be effected at low cost in an assembly line, e.g., with use of suitable chuck devices and welding methods or the like. A weight-saving construction of light metal for the rack and pinion jacks of the lifting and depositing device, i.e., with all of the parts of the rack and pinion jacks (except for the gearing parts) is another advantage of the present invention. Indeed, in this case, one need only undertake a suitable surface treatment of the bearing or guide surfaces in the relatively short guide tubes as well as on the outside circumference of the tubular uprights. A great cost savings is thus obtained.

In accordance with one embodiment of the invention, the connection of the guide tube with each tubular winch shank is simplified. A tip-stretched sleeve-like enlargement or a separate connection sleeve simplify the construction of the guide tube with the tubular winch shank along the axis thereof.

Further, the formation of the guide surface in the guide tube is further simplified when the guide tube is provided with a number of guide surfaces separated or set apart by length-wise grooves from each other, side-by-side, for the uprights and their racks with lengthwise cutouts taking up little play.

Additionally, the axial length of the wall of the guide tube preferably is reinforced over the top and bottom ends so that the remaining parts of the guide tube can advantageously be formed with a relatively smaller wall thickness, thereby resulting in a weight and cost savings.

According to another configuration of the invention, the winch gearing housing is formed integral with the guide tube to avoid any errors of assembly of the rack and pinion jack gearing operation. Also, the bottom brackets or bearing eyes for the bottom brackets preferably are assembled integrally with the guide tube.

According to still another configuration of the invention, when the top bracket and a hinged tie bar with the tubular winch shank are connected, e.g., by welding or the like and/or safety screws, a tightly connectable sheathing is formed with bearing eyes for the brackets and the hinged tie bar, and the tubular winch shanks can advantageously be economically manufactured with their guide tubes of a standard dimension, and the sheathings with the bearing eyes for the brackets and the hinged tie rod can be set as desired at different levels and then can be affixed to the winch shanks.

By utilizing selected transverse cross sections for the winch shank, in accordance with this invention, weight savings can be effected.

BRIEF DESCRIPTION OF THE DRAWINGS

The invention is described hereinafter relative to the drawings of exemplary embodiments. They show.

DESCRIPTION OF THE PREFERRED EMBODIMENTS

Figure 1:
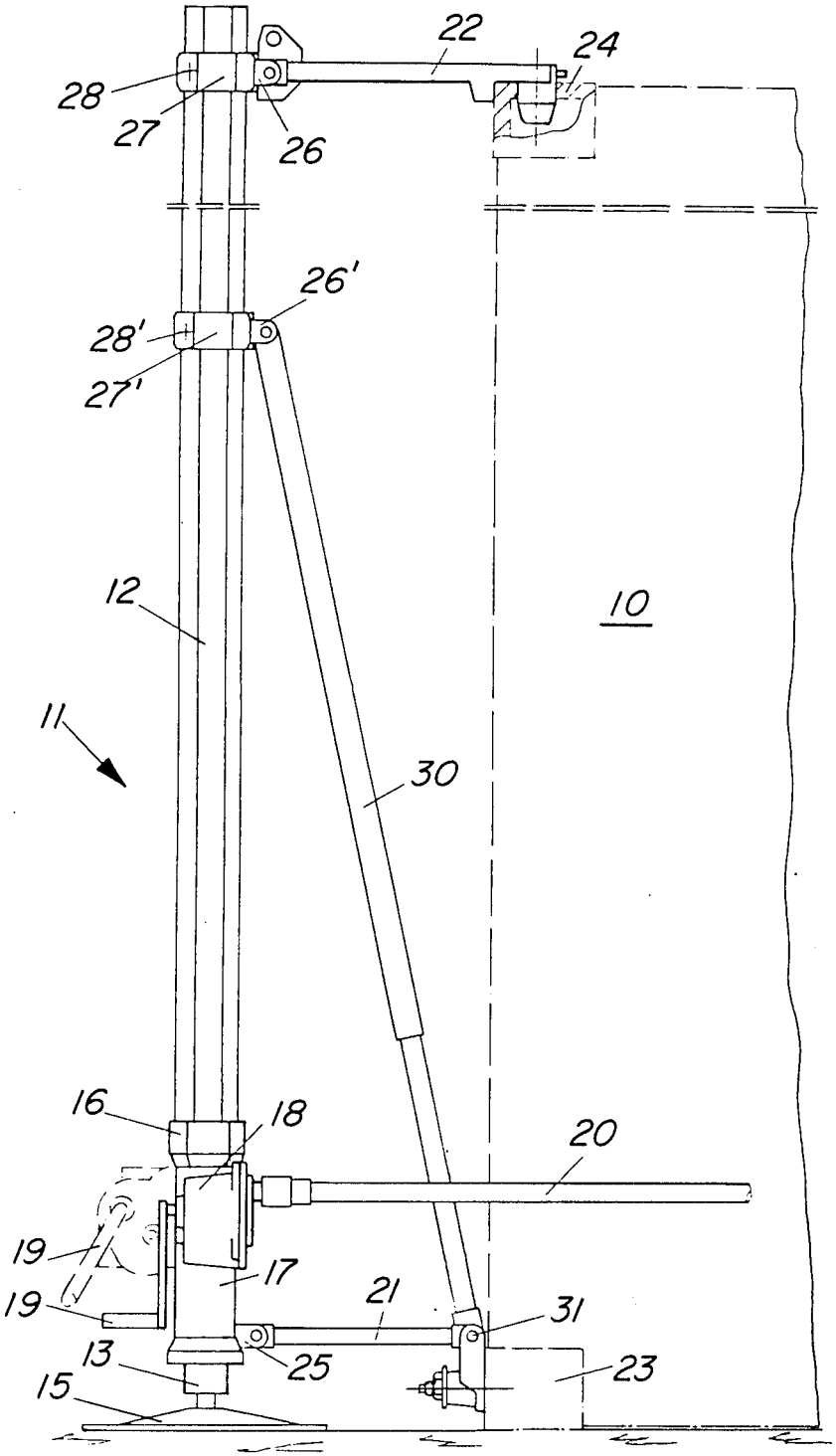
FIG. 1 is a side elevational view of a rack and pinion jack of the lifting and depositing device attached to a corner of a container, only part of which is shown, which is placed on the ground.
Figure 2:
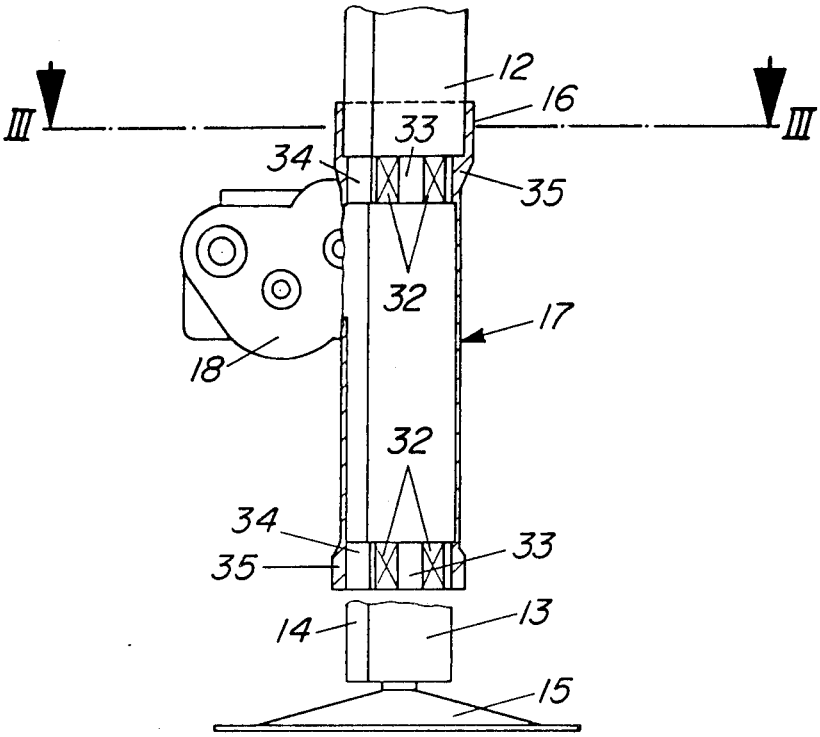
FIG. 2 is an elevational view, with parts broken away and parts in section, of the guide tube with tip-stretched winch gearing housing and a part of the tubular winch shank, with which the guide tube is connected, as well as a part of the support to be guided therein with tooth racks.
Figure 3:
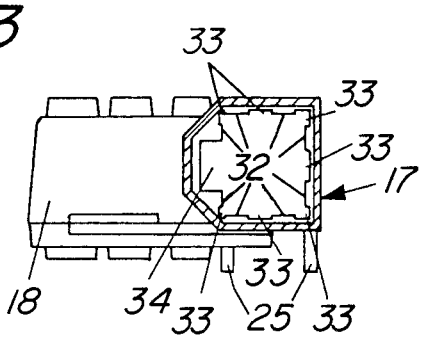
FIG. 3 is a sectional view taken substantially along line III—III of FIG. 2 without the tubular winch shank.

The lifting and depositing device of the present invention is intended for rectangular containers 10, which are, for example, to be lifted from the ground and deposited upon the loading surface of a truck, or lifted from the truck and deposited upon the ground. The lifting and depositing device, however, can also support the container freely at a more or less great distance from the ground. For this purpose, the lifting and depositing device has four identical rack and pinion jacks 11 (FIG. 1) or 11' (FIG. 6) which are mounted detachably in a known manner as shown in FIG. 1 on the container corners. In the case of the embodiment of FIG. 6, the jacks 11' can be pivotably articulated on the container corners.

The construction and operation of one of the four identical rack and pinion jacks 11 is now described more closely relative to FIGS. 1–4. Each rack and pinion jack 11 includes a tubular winch shank 12 which is almost the height of the container, a tubular upright 13 that is axially movable therein, to which is fastened a rack 14, as in FIG. 4, and which is provided with a foundation plate 15 on the bottom. The bottom end of tubular winch shank 12 fits in a sleeve-like enlargement 16 at the top end of a guide tube 17 for the tubular upright 13, inserted with its rack 14 and tightly connected therewith by welding or the like. This guide tube 17, as shown in FIG. 1, is of a length which is only a fraction of that of tubular winch shank 12, preferably is manufactured as cast element and is provided with a tip-stretched housing 18 for the winch gearing. The features of the winch gearing are not shown, as they are well known in the art. The winch gearing is operated by a handcrank 19, and a drive bevel gearing (not shown) of the winch gearing meshes with rack 14 on the tubular upright 13. According to the direction of rotation of handcrank 19, winch shank 12 and guide tube 17 connected therewith are moved upwardly or downwardly relative to the tubular upright 13 resting on the ground to raise or lower the container 10. In this embodiment, each two winch gearings are connected so that they can be driven by the adjacent side rack and pinion jacks 11 through a shaft 20, so that only two persons are required to operate the corresponding handcrank 19 for the handling of the container 10. The arrangment of rack and pinion jacks 11 can be such that shafts 20 extend substantially parallel to the front (FIG. 1) or the sides of container 10, shown by the winch gearing positions shown in broken lines in FIG. 1.

Figure 4:
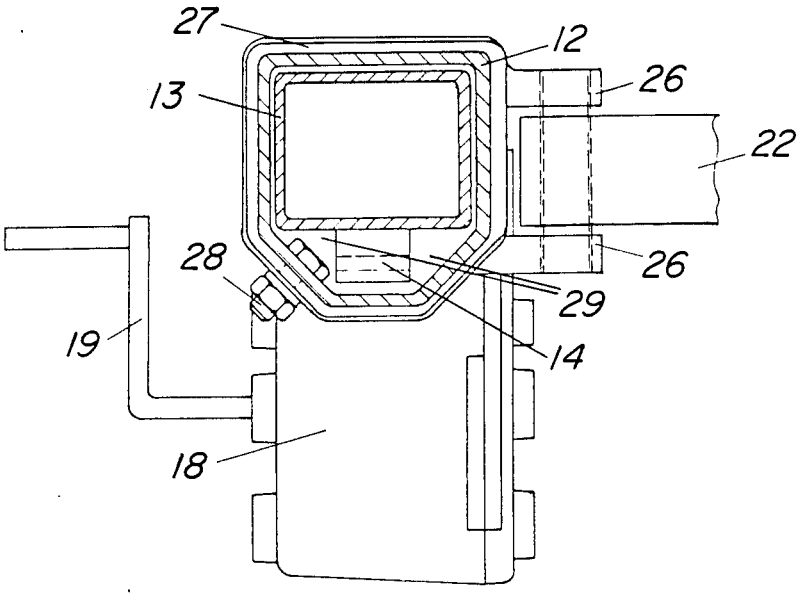
FIG. 4 is a plan view partly in section, of a portion of the rack and pinion jack of FIG. 1, somewhat enlarged.

A bottom bracket 21 and a top bracket 22 serve to connect each rack and pinion jack 11 with the container 10, as they can be brought into contact with the standardized corner fittings 23 and 24 on the container 10 in a known manner. Bottom bracket 21 is articulated on two bearing eyes 25, which are tip-stretched in turn on guide tube 17. Top bracket 22 is articulated on two bearing eyes 26 (see FIG. 4), which are connected together and with a sheathing 27, which is mounted to fit on winch shank 12 and is welded or otherwise tightly with this shank. This weld connection or the like, as shown in broken lines in FIG. 4, can additionally be reinforced or replaced by a screw 28. FIG. 4 also shows that the transverse cross section of winch shank 12 creates free spaces 29 between winch shank 12 and rack 14 or upright 13, which as desired can receive the head of a safety screw 28 without impairing the required relative movement between winch shank and upright or toothed rack.

A sheathing 27' with bearing eyes 26', similar to sheathing 27, is mounted at a certain distance from sheathing 27 downward on winch shank 12 in the same manner. On bearing eyes 26' of this sheathing 27' is articulated the top end of hinged tie bar 30, of which the bottom end is articulated at 31 with the container and bottom bracket 21. Sheathings 27 and 27', dependent upon the relative height of the containers 10 to be handled, can advantageously be set optimally at the proper height on winch shank 12 and subsequently can be connected rigidly therewith.

While tubular upright 13 can extend with rack 14 fastened to it with a certain amount of play at the side through winch shank 12, guide tube 17 serves to accurately fit and guide uprights 13 with rack 14. Since this accurately fitting guide lies near the winch gearing, an exact engagement of its drive bevel gearing in rack 14 is assured. Guide tube element 17 is provided at its top and bottom ends with axially extending, relatively short guide surfaces 32, which are preferably separated from each other by lengthwise grooves 33 around the periphery. These guide surfaces 32 engage with all four sides of tubular uprights 13, while lengthwise cutouts 34 receive rack 14 in guide tube 17 with slight play. The wall sections 35 which extend around guide surfaces 32 are greatly reinforced (FIG. 2) in comparison with the remaining part of the guide tube 17.

With the exception of the gearing parts, all of the parts of rack and pinion jacks 11 can be manufactured of light metal, and in this case one need harden only the guide surfaces 32 and the circumferences of tubular uprights 13, in case this also consists of a light metal alloy, by known surface treatments.

Figure 5:
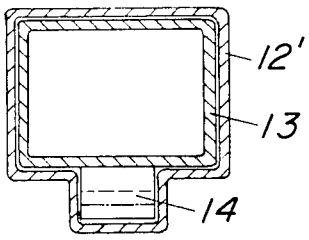
FIG. 5 is a plan view in section of a modified embodiment of a winch shank which closely follows the outline of the upright with its rack.

In the embodiment of FIG. 5, the transverse cross section of winch shank 12' is relatively tightly fitted to the contour of tubular upright 13, and rack 14 engages therewith. It should here be noted that rack 14 can be screwed onto tubular upright 13 or even can be formed integral therewith in accordance with the teachings of the present invention.

Figure 6:
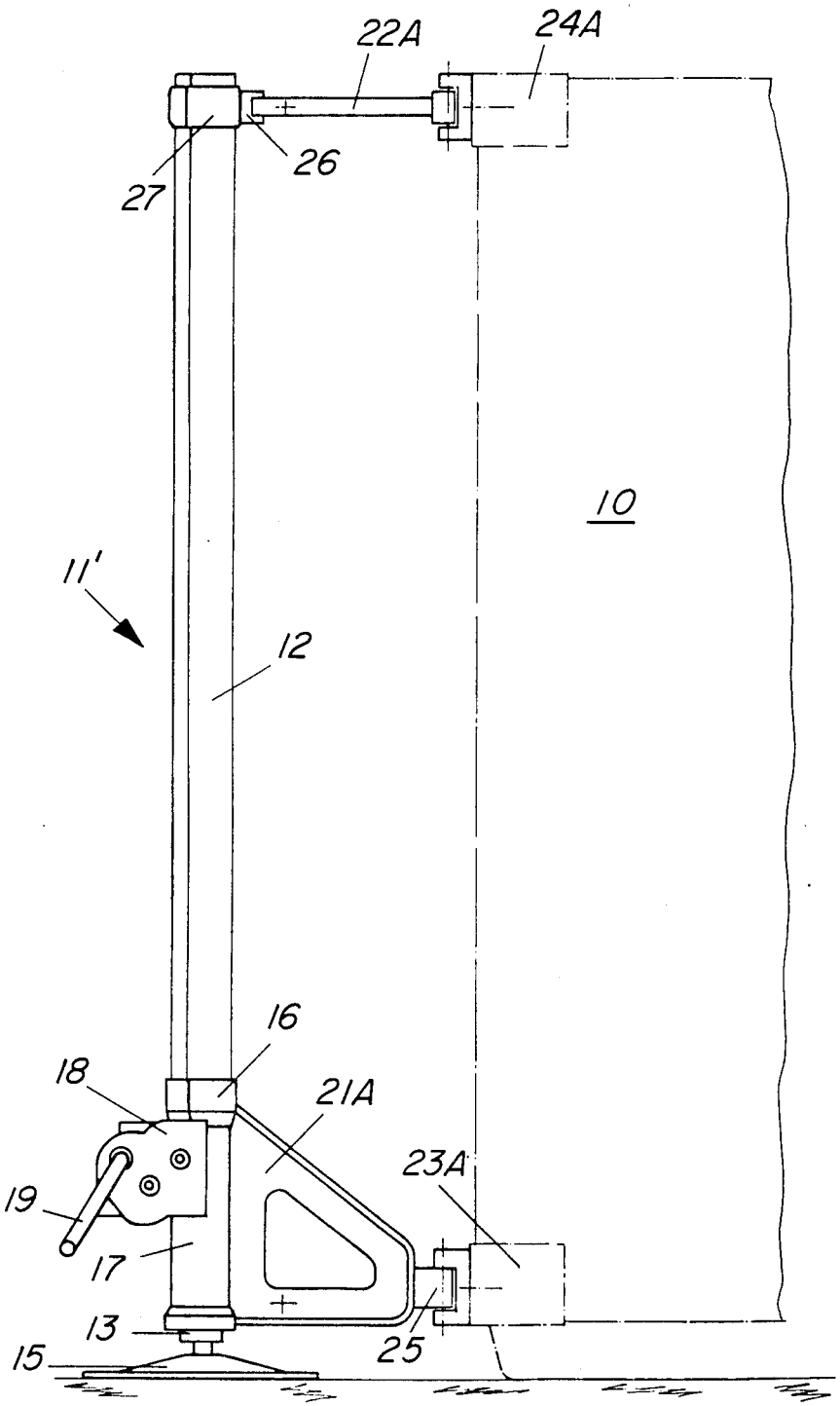
FIG. 6 is a side elevational view similar to FIG. 1 of a further embodiment of the lifting and depositing device, in which the rack and pinion jacks are pivotably mounted on the container corners.

Rack and pinion jack 11' of FIG. 6 corresponds essentially to that of FIG. 1 and the same parts are therefore indicated with the same reference numerals. In one modification of the embodiment of FIG. 1, bottom bracket 21 A is tip-stretched on guide tube 17, i.e., guide tube 17 and bracket 21 A (and hinged tie bar) form one part. Bottom bracket 21 A and top bracket 22 A are mounted on the corner fittings 23 A and 24 A of container 10, pivotable around a horizontal axis, so that, e.g., following lifting of container 10 and depositing it on the loading surface of a truck, rack and pinion jacks 11' can be moved or folded to the side on container 10. Guide tube 17 corresponds in its configuration and operation to that of the first exemplary embodiment.

We claim:

1. Lifting and depositing apparatus for a transportable container, with rack jacks to be attached to the corners of the container by means of crossbars, wherein each rack jack comprises a tubular winch shank and a tubular support that is axially movable therein, a lifting jack part secured to said winch shank and having said tubular support slidably mounted therein, said lifting jack part having a length that is only a fraction of a height of the container, and a jack gearing mounted on said lifting jack part, characterized in that said lifting jack part guiding said support is a guide tube located at a bottom end of said tubular winch shank said winch being approximately the same height as the container, said guide tube being provided on its interior with a plurality of axially extending guide surfaces for the support which are interrupted by lengthwise grooves, said support having a rack thereon, said guide tube having a lengthwise recess on its interior for receiving the rack therein with slight play, said guide surfaces extending only through short axial peripheral areas at top and bottom ends of said guide tube, said guide tube being reinforced over on axial length of said guide surfaces, and said support having an exterior shape such that it does not extend into said lengthwise grooves.

2. Lifting and depositing apparatus as in claim 1, characterized in that the guide tube (17) has a sleeve-shaped enlargement (16), and the tubular winch shank (12) is received within said sleeve-shaped enlargement (16) and is connected thereto.

* * * * *